US007383179B2

(12) United States Patent
Alves et al.

(10) Patent No.: US 7,383,179 B2
(45) Date of Patent: Jun. 3, 2008

(54) METHOD OF CASCADING NOISE REDUCTION ALGORITHMS TO AVOID SPEECH DISTORTION

(75) Inventors: Rogerio G. Alves, Windsor (CA); Kuan-Chich Yen, Northville, MI (US); Jeff Chisholm, Royal Oak, MI (US)

(73) Assignee: Clarity Technologies, Inc., Auburn Hills, MI (US)

( * ) Notice: Subject to any disclaimer, the term of this patent is extended or adjusted under 35 U.S.C. 154(b) by 456 days.

(21) Appl. No.: 10/952,404

(22) Filed: Sep. 28, 2004

(65) Prior Publication Data

US 2006/0074646 A1 Apr. 6, 2006

(51) Int. Cl.
*G10L 21/02* (2006.01)
*G10L 21/00* (2006.01)

(52) U.S. Cl. ..... 704/228; 704/226

(58) Field of Classification Search ..... 704/226, 704/228, 233
See application file for complete search history.

(56) References Cited

U.S. PATENT DOCUMENTS

| | | | | |
|---|---|---|---|---|
| 5,012,519 | A * | 4/1991 | Adlersberg et al. | 704/226 |
| 6,351,731 | B1 * | 2/2002 | Anderson et al. | 704/233 |
| 6,377,637 | B1 * | 4/2002 | Berdugo | 375/346 |
| 6,415,253 | B1 * | 7/2002 | Johnson | 704/210 |
| 6,839,666 | B2 * | 1/2005 | Chandran et al. | 704/226 |
| 7,068,798 | B2 * | 6/2006 | Hugas et al. | 381/93 |
| 7,072,831 | B1 * | 7/2006 | Etter | 704/226 |
| 7,146,316 | B2 * | 12/2006 | Alves | 704/233 |
| 2004/0064307 | A1 * | 4/2004 | Scalart et al. | 704/205 |
| 2005/0240401 | A1 * | 10/2005 | Ebenezer | 704/226 |

FOREIGN PATENT DOCUMENTS

WO WO 2004/036552 A1 4/2004

OTHER PUBLICATIONS

Ogata et al., "Reinforced Spectral Subtraction Method to Enhance Speech Signal", IEEE Catalogue No. 01CH37239, Aug. 2001.*
Fu et al., "A Novel Speech Enhancement System Based On Wavelet Denoising", Center for Spoken Language Understanding, OGI School of Science and Engineering at Oregon Health & Science University, Feb. 2003.*
Phil S. Whitehead, David V. Anderson, Mark A. Clements, "Adaptive, Acoustic Noise Suppression For Speech Enhancement," Proceedings 2003 International Conference On Multimedia And Expo, vol. 1, 2003, pp. I-565-I-568.

(Continued)

*Primary Examiner*—Patrick N. Edouard
*Assistant Examiner*—Douglas Godbold
(74) *Attorney, Agent, or Firm*—Brooks Kushman P.C.

(57) ABSTRACT

A method of reducing noise by cascading a plurality of noise reduction algorithms is provided. A sequence of noise reduction algorithms are applied to the noisy signal. The noise reduction algorithms are cascaded together, with the final noise reduction algorithm in the sequence providing the system output signal. The sequence of noise reduction algorithms includes a plurality of noise reduction algorithms that are sufficiently different from each other such that resulting distortions and artifacts are sufficiently different to result in reduced human perception of the artifact and distortion levels in the system output signal.

5 Claims, 4 Drawing Sheets

OTHER PUBLICATIONS

Jongseo Sohn, Wonyong Sung, "A Voice Activity Detector Employing Soft Decision Based Noise Spectrum Adaptation," Proceedings of the 1998 IEEE International Conference on Acoustics, Speech and Signal Processing, 1998, vol. 1, May 12, 1998, pp. 365-368.

Yan Ming Cheng, Dusan Macho, Yuanjun Wei, Douglas Ealey, Holly Kelleher, David Pearce, William Kusher, and Tenkasi Ramabadran, "A Robust Front-End Algorithm for Distributed Speech Recognition," Proceedings European Conference on Speech Communication and Technology, vol. 1, 2001, pp. 425-428.

Dusan Macho, Laurent Mauuary, Bernhard Noe, Yan Ming Cheng, Doug Ealey, Denis Jouver, Holly Kelleher, David Pearce, Fabien Saadoun, "Evaluation Of A Noise-Robust DSR Front-End On Aurora Databases," ICSLP 2002, 7th International Conference on Spoken Language Processing, Denver, CO, Sep. 16-20, 2002, International Conference On Spoken language Processing (ICSLP), vol. 4 of 4, Sep. 16, 2002, pp. 17-20.

* cited by examiner

METHOD OF CASCADING NOISE REDUCTION ALGORITHMS TO AVOID SPEECH DISTORTION

BACKGROUND OF THE INVENTION

1. Field of the Invention

The invention relates to a method of cascading noise reduction algorithms to avoid speech distortion.

2. Background Art

For years, algorithm developers have improved noise reduction by concatenating two or more separate noise cancellation algorithms. This technique is sometimes referred to as double/multi-processing. However, the double/multi-processing technique, while successfully increasing the dB improvement in signal-to-noise ratio (SNR), typically results in severe voice distortion and/or a very artificial noise remnant. As a consequence of these artifacts, double/multi-processing is seldom used.

For the foregoing reasons, there is a need for an improved method of cascading noise reduction algorithms to avoid speech distortion.

SUMMARY OF THE INVENTION

It is an object of the invention to provide an improved method of cascading noise reduction algorithms to avoid speech distortion.

The invention comprehends a method for avoiding severe voice distortion and/or objectionable audio artifacts when combining two or more single-microphone noise reduction algorithms. The invention involves using two or more different algorithms to implement speech enhancement. The input of the first algorithm/stage is the microphone signal. Each additional algorithm/stage receives the output of the previous stage as its input. The final algorithm/stage provides the output.

The speech enhancing algorithms may take many forms and may include enhancement algorithms that are based on known noise reduction methods such as spectral subtraction types, wavelet denoising, neural network types, Kalman filter types and others.

According to the invention, by making the algorithms sufficiently different, the resulting artifacts and distortions are different as well. Consequently, the resulting human perception (which is notoriously non-linear) of the artifact and distortion levels is greatly reduced, and listener objection is greatly reduced.

In this way, the invention comprehends a method of cascading noise reduction algorithms to maximize noise reduction while minimizing speech distortion. In the method, sufficiently different noise reduction algorithms are cascaded together. Using this approach, the advantage gained by the increased noise reduction is generally perceived to outweigh the disadvantages of the artifacts introduced, which is not the case with the existing double/multi-processing techniques.

At the more detailed level, the invention comprehends a two-part or two-stage approach. In these embodiments, a preferred method is contemplated for each stage.

In the first stage, an improved technique is used to implement noise cancellation. A method of noise cancellation is provided. A noisy signal resulting from an unobservable signal corrupted by additive background noise is processed in an attempt to restore the unobservable signal. The method generally involves the decomposition of the noisy signal into subbands, computation and application of a gain factor for each subband, and reconstruction of the speech signal. In order to suppress noise in the noisy speech, the envelopes of the noisy speech and the noise floor are obtained for each subband. In determining the envelopes, attack and decay time constants for the noisy speech envelope and noise floor envelope may be determined. For each subband, the determined gain factor is obtained based on the determined envelopes, and application of the gain factor suppresses noise.

At a more detailed level, the first stage method comprehends additional aspects of which one or more are present in the preferred implementation. In one aspect, different weight factors are used in different subbands when determining the gain factor. This addresses the fact that different subbands contain different noise types. In another aspect, a voice activity detector (VAD) is utilized, and may have a special configuration for handling continuous speech. In another aspect, a state machine may be utilized to vary some of the system parameters depending on the noise floor estimation. In another aspect, pre-emphasis and de-emphasis filters may be utilized.

In the second stage, a different improved technique is used to implement noise cancellation. A method of frequency domain-based noise cancellation is provided. A noisy signal resulting from an unobservable signal corrupted by additive background noise is processed in an attempt to restore the unobservable signal. The second stage receives the first stage output as its input. The method comprises estimating background noise power with a recursive noise power estimator having an adaptive time constant, and applying a filter based on the background noise power estimate in an attempt to restore the unobservable signal.

Preferably, the background noise power estimation technique considers the likelihood that there is no speech power in the current frame and adjusts the time constant accordingly. In this way, the noise power estimate tracks at a lesser rate when the likelihood that there is no speech power in the current frame is lower. In any case, since background noise is a random process, its exact power at any given time fluctuates around its average power.

To avoid musical or watery noise that would occur due to the randomness of the noise particularly when the filter gain is small, the method further comprises smoothing the variations in a preliminary filter gain to result in an applied filter gain having a regulated variation. Preferably, an approach is taken that normalizes variation in the applied filter gain. To achieve an ideal situation, the average rate should be proportional to the square of the gain. This will reduce the occurrence of musical or watery noise and will avoid ambience. In one approach, a pre-estimate of the applied filter gain is the basis for adjusting the adaption rate.

DETAILED DESCRIPTION OF THE PREFERRED EMBODIMENT

Figure 1:
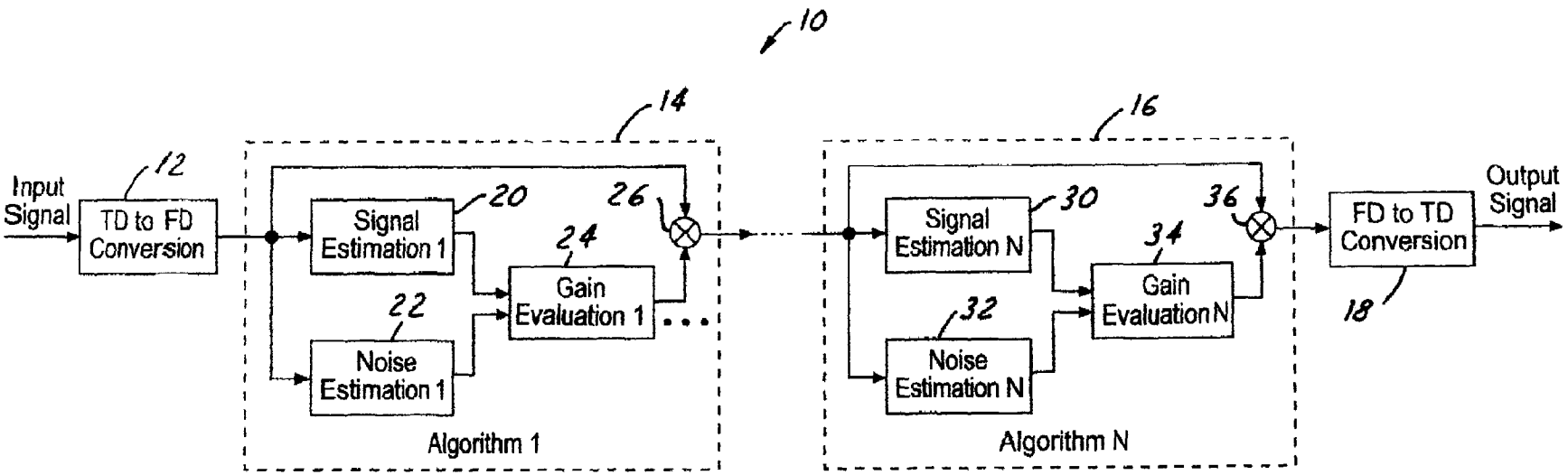
FIG. 1 is a diagram illustrating cascaded noise reduction algorithms to avoid speech distortion in accordance with the invention, with the algorithms being sufficiently different such that the resulting artifacts and distortions are different.

FIG. 1 illustrates a method of cascading noise reduction algorithms to avoid speech distortion at 10. The method may be employed in any communication device. An input signal is converted from the time domain to the frequency domain at block 12. Blocks 14 and 16 depict different algorithms for implementing speech enhancement. Conversion back to the time domain from the frequency domain occurs at block 18.

The first stage algorithm 14 receives its input signal from block 12 as the system input signal. Signal estimation occurs at block 20, while noise estimation occurs at block 22. Block 24 depicts gain evaluation. The determined gain is applied to the input signal at 26 to produce the stage output.

The invention involves two or more different algorithms, and algorithm N is indicated at block 16. The input of each additional stage is the output of the previous stage with block 16 providing the final output to conversion block 18. Like algorithm 14, algorithm 16 includes signal estimation block 30, noise estimation block 32, and gain evaluation block 34, as well as multiplier 36 which applies the gain to the algorithm input to produce the algorithm output which for block 16 is the final output to block 18.

It is appreciated that the illustrated embodiment in FIG. 1 may employ two or more algorithms. The speech enhancing algorithms may take many forms and may include enhancement algorithms that are based on known noise reduction methods such as spectral subtraction types, wavelet denoising, neural network types, Kalman filter types and others. By making the algorithms sufficiently different, the resulting artifacts and distortions are different as well. In this way, this embodiment uses multiple stages that are sufficiently different from each other for processing.

Figure 2:
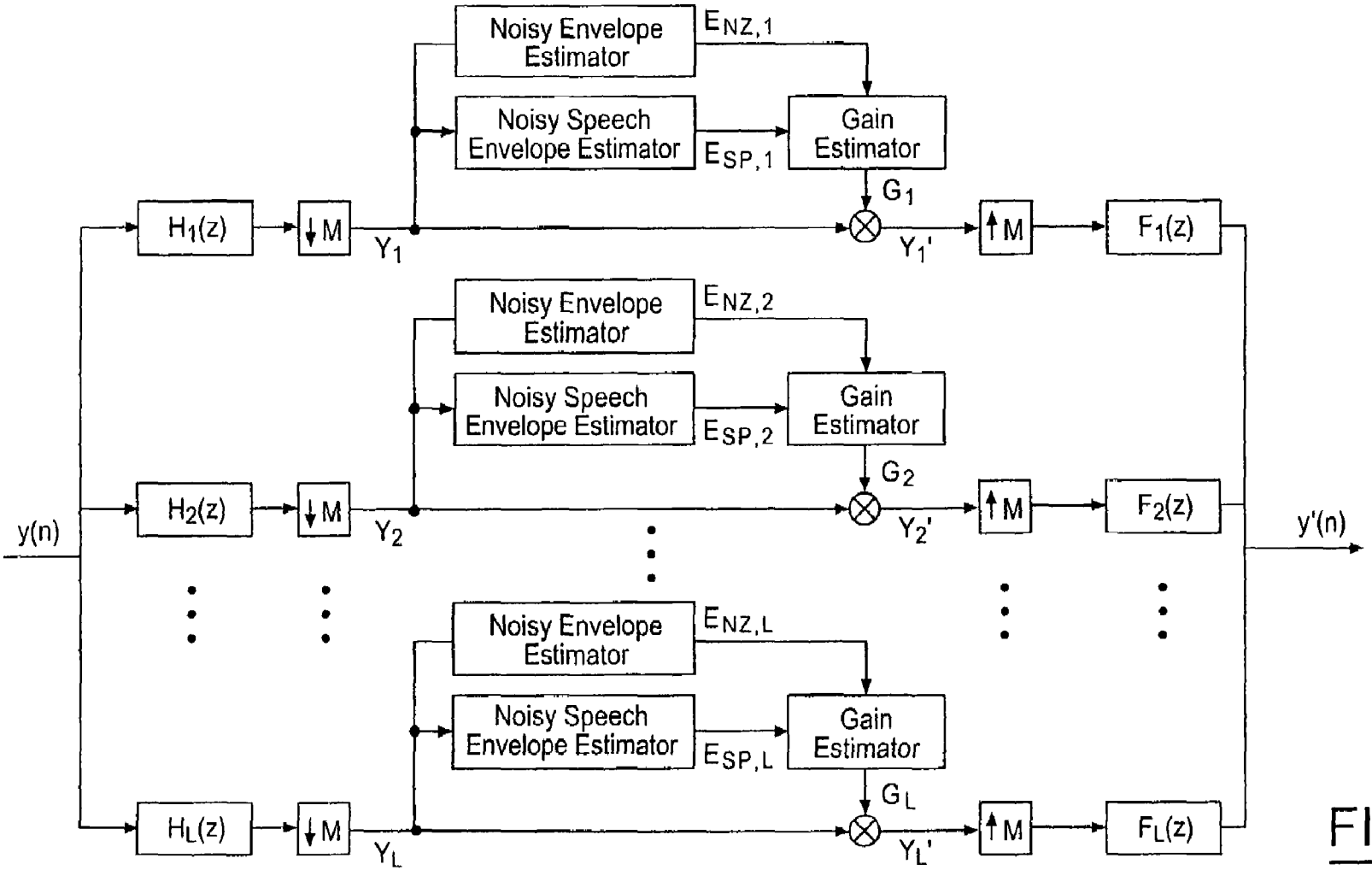
FIGS. 2-3 illustrate the first stage algorithm in the preferred embodiment of the invention.
Figure 3:
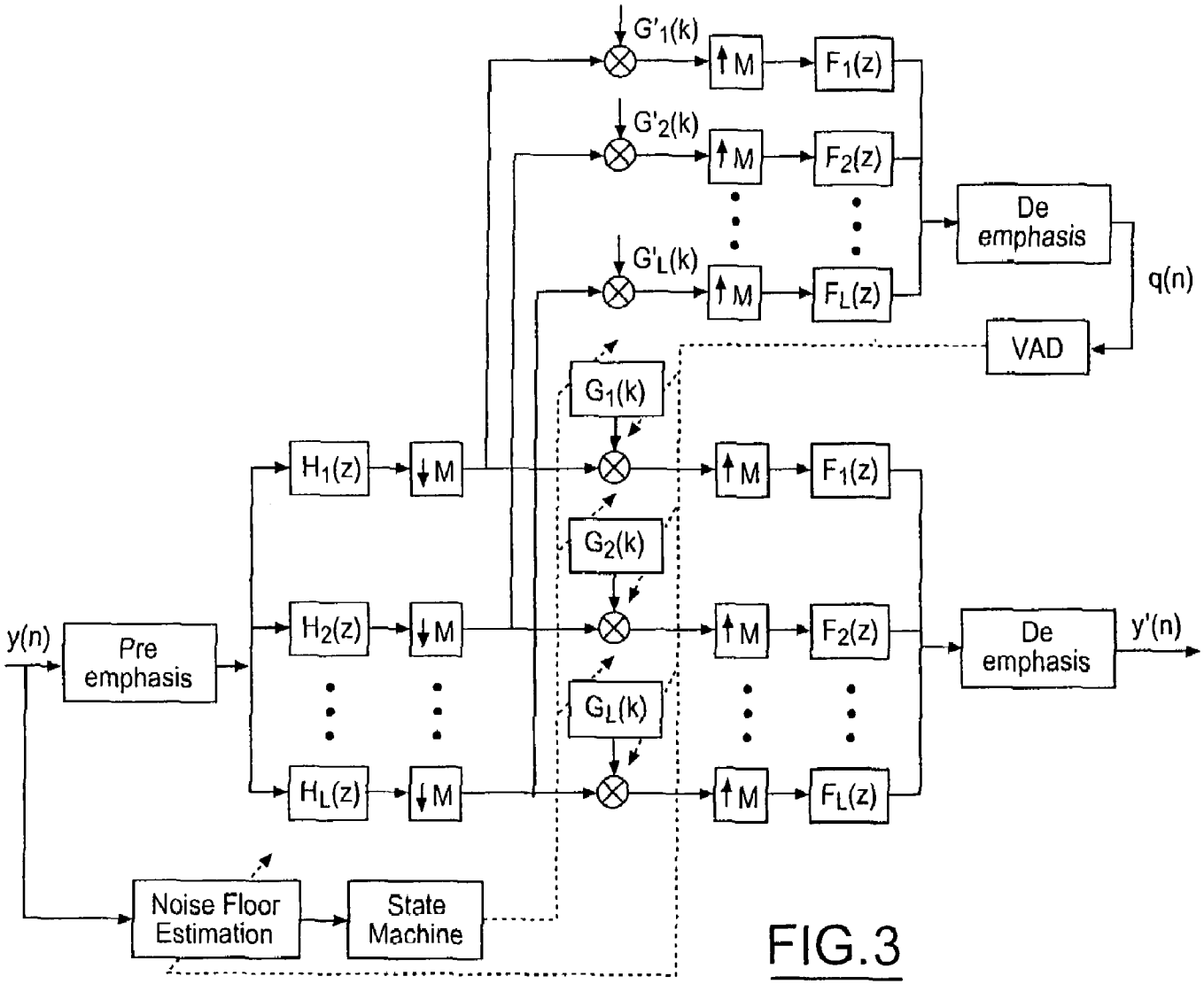

With reference to FIGS. 2-3, this first stage noise cancellation algorithm considers that a speech signal s(n) corrupted by additive background noise v(n) produces a noisy speech signal y(n), expressed as follows:

$$y(n)=s(n)+v(n).$$

As best shown in FIG. 2, the algorithm splits the noisy speech, y(n), in L different subbands using a uniform filter bank with decimation. Then for each subband, the envelope of the noisy speech and the envelope of the noise are obtained, and based on these envelopes a gain factor is computed for each subband i. After that, the noisy speech in each subband is multiplied by the gain factors. Then, the speech signal is reconstructed.

In order to suppress the noise in the noisy speech, the envelopes of the noisy speech ($E_{SP,i}(k)$) and noise floor ($E_{NZ,i}(k)$) for each subband are obtained, and using the obtained values a gain factor for each subband is calculated. These envelopes for each subband i, at frame k, are obtained using the following equations:

$$E_{SP,i}(k)=\alpha E_{SP,i}(k-1)+(1-\alpha)|Y_i(k)|$$

and $$E_{NZ,i}(k)=\beta E_{NZ,i}(k-1)+(1-\beta)|Y_i(k)|$$

where $|Y_i(k)|$ represents the absolute value of the signal in each subband after the decimation, and the constants α and β are defined as:

$$\alpha = e^{\frac{-1}{\frac{f_s}{M}\cdot \text{speech_estimation_time}}}$$

$$\beta = e^{\frac{-1}{\frac{f_s}{M}\cdot \text{noise_estimation_time}}}$$

where ($f_s$) represents the sample frequency of the input signal, M is the down sampling factor, and speech_estimation_time and noise_estimation_time are time constants that determine the decay time of speech and noise envelopes, respectively.

The constants α and β can be implemented to allow different attack and decay time constants as follows:

$$\alpha = \begin{cases} \alpha_a, & \text{If, } |Y_i(k)| \geq E_{SP,i}(k-1) \\ \alpha_d, & \text{If, } |Y_i(k)| < E_{SP,i}(k-1) \end{cases}$$

$$\beta = \begin{cases} \beta_a, & \text{If, } |Y_i(k)| \geq E_{NZ,i}(k-1) \\ \beta_d, & \text{If, } |Y_i(k)| < E_{NZ,i}(k-1) \end{cases}$$

and where the subscript (a) indicates the attack time constant and the subscript (d) indicates the decay time constant.

Example default parameters are:

Speech_attack=0.001 sec.

Speech_decay=0.010 sec.

Noise_attack=4 sec.

Noise_decay=1 sec.

After obtaining the values of $E_{SP,i}(k)$ and $E_{NZ,i}(k)$, the value of the gain factor for each subband is calculated by:

$$G_i(k) = \frac{E_{SP,i}(k)}{\gamma E_{NZ,i}(k)}$$

where the constant γ is an estimate of the noise reduction, since in "no speech" periods $E_{SP,i}(k) \approx E_{NZ,i}(k)$, the gain factor becomes:

$$G_i(K) \approx 1/\gamma.$$

After computing the gain factor for each subband, if $G_i(k)$ is greater than 1, $G_i(k)$ is set to 1.

With continuing reference to FIGS. 2 and 3, several more detailed aspects are illustrated. Different γ can be used for each subband based on the particular noise characteristic. For example, considering the commonly observed noise inside of a car (road noise), most of the noise is in the low frequencies, typically between 0 and 1500 Hz. The use of different γ for different subbands can improve the performance of the algorithm if the noise characteristics of different environments are known. With this approach, the gain factor for each subband is given by:

$$G_i(k) = \frac{E_{SP,i}(k)}{\gamma_i E_{NZ,i}(k)}.$$

Many systems for speech enhancement use a voice activity detector (VAD). A common problem encountered in implementation is the performance in medium to high noise environments. Generally a more complex VAD needs to be implemented for systems where background noise is high. A preferred approach is first to implement the noise cancellation system and then to implement the VAD. In this case, a less complex VAD can be positioned after the noise canceler to obtain results comparable to that of a more complex VAD that works directly with the noisy speech input. It is possible to have, if necessary, two outputs for the noise canceler system, one to be used by the VAD (with aggressive $\gamma'_i$ to obtain the gain factors $G'_i(k)$) and another one to be used for the output of the noise canceler system (with less aggressive and more appropriate $\gamma_i$, corresponding to weight factors for different subbands based on the appropriate environment characteristics). The block diagram considering the VAD implementation is shown in FIG. 3.

The VAD decision is obtained using q(n) as input signal. Basically, two envelopes, one for the speech processed by the noise canceler ($e'_{SP}(n)$), and another for the noise floor estimation ($e'_{NZ}(n)$) are obtained. Then, a voice activity detection factor is obtained based on the ratio ($e'_{SP}(n)/e'_{NZ}(n)$). When this ratio exceeds a determined threshold (T), VAD is set to 1 as follows:

$$VAD = \begin{cases} 1, & \text{If } e'_{SP}(n)/e'_{NZ}(n) > T \\ 0, & \text{otherwise} \end{cases}.$$

The noise cancellation system can have problems if the signal in a determined subband is present for long periods of time. This can occur in continuous speech and can be worse for some languages than others. Here, long period of time means time long enough for the noise floor envelope to begin to grow. As a result, the gain factor for each subband $G_i(k)$ will be smaller than it really needs to be, and an undesirable attenuation in the processed speech (y'(n)) will be observed. This problem can be solved if the update of the envelope noise floor estimation is halted during speech periods in accordance with a preferred approach; in other words, when VAD=1, the value of $E_{SP,i}(k)$ will not be updated. This can be described as:

$$E_{NZ,i}(k) = \begin{cases} \beta E_{NZ,i}(k-1) + (1-\beta)|Y_i(k)|, & \text{If } VAD = 0 \\ E_{NZ,i}(k-1), & \text{If } VAD = 1 \end{cases}.$$

This is shown in FIG. 3, by the dotted line from the output of the VAD block to the gain factors in each subband $G_i(k)$ of the noise suppressor system.

Different noise conditions (for example: "low", "medium" and "high" noise condition) can trigger the use of different sets of parameters (for example: different values for $\gamma_i(k)$ for better performance. A state machine can be implemented to trigger different sets of parameters for different noise conditions. In other words, implement a state machine for the noise canceler system based on the noise floor and other characteristics of the input signal (y(n)). This is also shown in FIG. 3.

An envelope of the noise can be obtained while the output of the VAD is used to control the update of the noise floor envelope estimation. Thus, the update will be done only in no speech periods. Moreover, based on different applications, different states can be allowed.

The noise floor estimation ($e_{NZ}(n)$) of the input signal can be obtained by:

$$e_{NZ}(n) = \begin{cases} \beta e_{NZ}(n-1) + (1-\beta)|y(n)|, & \text{If } Vad = 0 \\ e_{NZ}(n-1), & \text{If } Vad = 1 \end{cases}.$$

For different thresholds ($T_1, T_2, \ldots, T_P$) different states for the noise suppressor system are invoked. For P states:

State_1, if $0<T<T_1$

State_2, if $T_1<T<T_2$

State_P, if $T_{p-1}<T<T_p$

State_P, if $T_{P-1}<T<T_P$

For each state, different parameters ($\gamma_p$, $\alpha_p$, $\beta_p$ and others) can be used. The state machine is shown in FIG. 3 receiving the output of the noise floor estimation.

Considering that the lower formants of the speech signal contain more energy and noise information in high frequencies is less prominent than speech information in the high frequencies, a pre-emphasis filter before the noise cancellation process is preferred to help obtain better noise reduction in high frequency bands. To compensate for the pre-emphasis filter a de-emphasis filter is introduced at the end of the process.

A simple pre-emphasis filter can be described as:

$$\hat{y}(n)=y(n)-a_1 \cdot y(n-1)$$

where $a_1$ is typically between $0.96 \leqq a_1 \leqq 0.99$.

To reconstruct the speech signal the inverse filter should be used:

$$y'(n)=\tilde{y}(n)-a_1 \cdot y'(n-1)$$

The pre-emphasis and de-emphasis filters described here are simple ones. If necessary, more complex, filter structures can be used.

Figure 4:
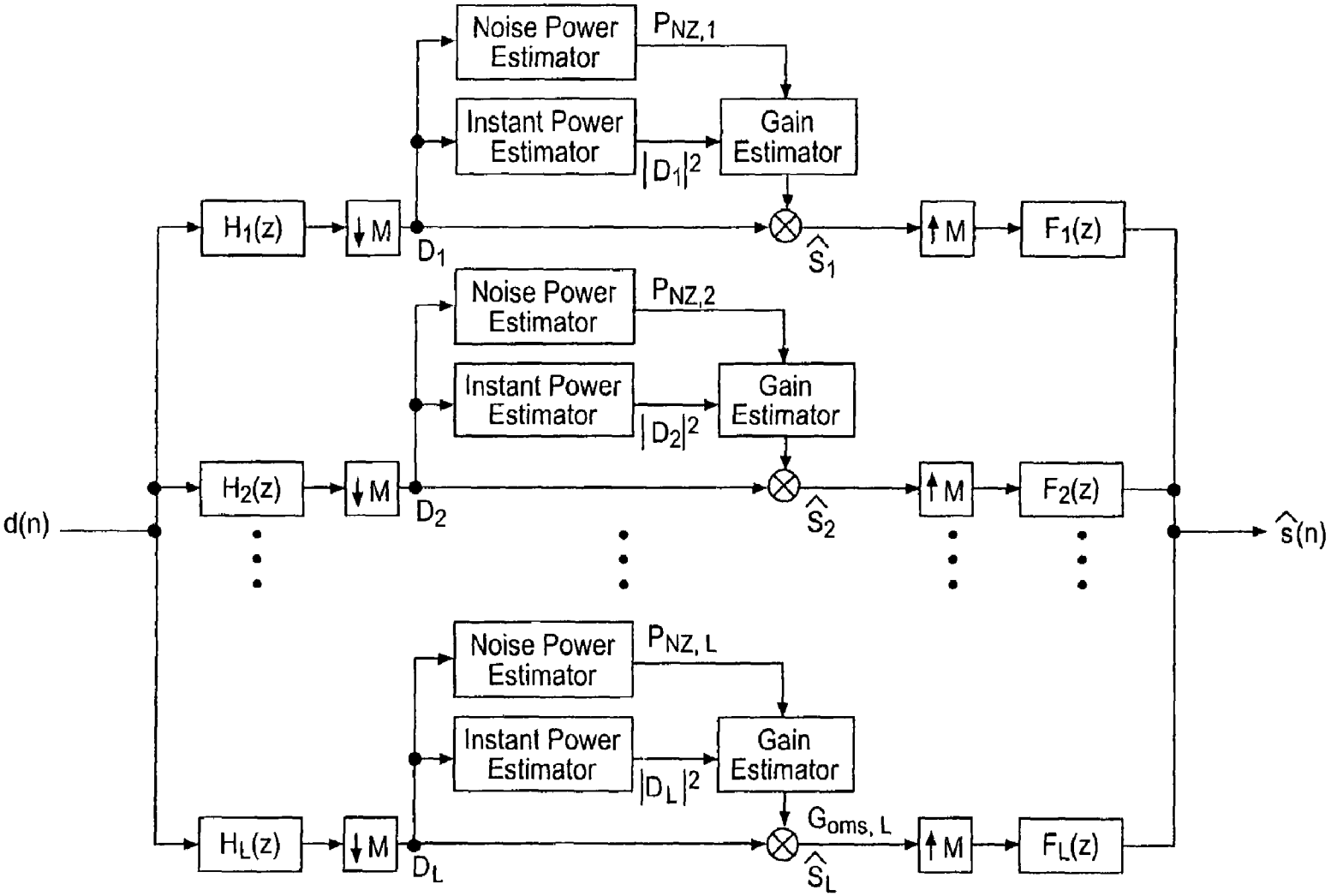
FIG. 4 illustrates the second stage algorithm in the preferred embodiment of the invention.

With reference to FIG. 4, the noise cancellation algorithm used in the second stage considers that a speech signal s(n) is corrupted by additive background noise v(n), so the resulting noisy speech signal d(n) can be expressed as $$d(n)=s(n)+v(n).$$

In the case of cascading algorithms d(n) could be the output from the first stage, with v(n) being the residual noise remaining in d(n).

Ideally, the goal of the noise cancellation algorithm is to restore the unobservable s(n) based on d(n). For the purpose of this noise cancellation algorithm, the background noise is defined as the quasi-stationary noise that varies at a much slower rate compared to the speech signal.

This noise cancellation algorithm is also a frequency-domain based algorithm. The noisy signal d(n) is split into L subband signals, $D_i(k)$,i=1,2 . . . L. In each subband, the average power of quasi-stationary background noise is tracked, and then a gain is decided accordingly and applied to the subband signals. The modified subband signals are subsequently combined by a synthesis filter bank to generate the output signal. When combined with other frequency-domain modules (the first stage algorithm described, for example), the analysis and synthesis filter-banks are moved to the front and back of all modules, respectively, as are any pre-emphasis and de-emphasis.

Because it is assumed that the background noise varies slowly compared to the speech signal, its power in each subband can be tracked by a recursive estimator $$P_{NZ,i}(k) = (1-\alpha_{NZ})P_{NZ,i}(k-1) + \alpha_{NZ}|D_i(k)|^2$$
$$= P_{NZ,i}(k-1) + \alpha_{NZ}(|D_i(k)|^2 - P_{NZ,i}(k-1))$$

where the parameter $\alpha_{NZ}$ is a constant between 0 and 1 that decides the weight of each frame, and hence the effective average time. The problem with this estimation is that it also includes the power of speech signal in the average. If the speech is not sporadic, significant over-estimation can result. To avoid this problem, a probability model of the background noise power is used to evaluate the likelihood that the current frame has no speech power in the subband. When the likelihood is low, the time constant $\alpha_{NZ}$ is reduced to drop the influence of the current frame in the power estimate. The likelihood is computed based on the current input power and the latest noise power estimate:

$$L_{NZ,i}(k) = \frac{|D_i(k)|^2}{P_{NZ,i}(k-1)}\exp\left(1-\frac{|D_i(k)|^2}{P_{NZ,i}(k-1)}\right)$$

and the noise power is estimated as $$P_{NZ,i}(k)=P_{NZ,i}(k-1)+(\alpha_{NZ}L_{NZ,i}(k)(|D_i(k)|^2-P_{NZ,i}(k-1)).$$

It can be observed that $L_{NZ,i}(k)$ is between 0 and 1. It reaches 1 only when $|D_i(k)|^2$ is equal to $P_{NZ,i}(k-1)$, and reduces towards 0 when they become more different. This allows smooth transitions to be tracked but prevents any dramatic variation from affecting the noise estimate.

In practice, less constrained estimates are computed to serve as the upper- and lower-bounds of $P_{NZ,i}(k)$. When it is detected that $P_{NZ,i}(k)$ is no longer within the region defined by the bounds, it is adjusted according to these bounds and the adaptation continues. This enhances the ability of the algorithm to accommodate occasional sudden noise floor changes, or to prevent the noise power estimate from being trapped due to inconsistent audio input stream.

In general, it can be assumed that the speech signal and the background noise are independent, and thus the power of the microphone signal is equal to the power of the speech signal plus the power of background noise in each subband. The power of the microphone signal can be computed as $|D_i(k)|^2$. With the noise power available, an estimate of the speech power is $$P_{SP,i}(k)=\max(|D_i(k)|^2-P_{NZ,i}(k),\ 0)$$

and therefore, the optimal Wiener filter gain can be computed as $$G_{T,i}(k) = \max\left(1-\frac{P_{NZ,i}(k)}{|D_i(k)|^2},\ 0\right).$$

However, since the background noise is a random process, its exact power at any given time fluctuates around its average power even if it is stationary. By simply removing the average noise power, a noise floor with quick variations is generated, which is often referred to as musical noise or watery noise. This is the major problem with algorithms based on spectral subtraction. Therefore, the instantaneous gain $G_{T,i}(k)$ needs to be further processed before being applied.

When $|D_i(k)|^2$ is much larger than $P_{NZ,i}(k)$, the fluctuation of noise power is minor compared to $|D_i(k)|^2$, and hence $G_{T,i}(k)$ is very reliable. On the other hand, when $|D_i(k)|^2$ approximates $P_{NZ,i}(k)$, the fluctuation of noise power becomes significant, and hence $G_{T,i}(k)$ varies quickly and is unreliable. In accordance with an aspect of the invention, more averaging is necessary in this case to improve the reliability of gain factor. To achieve the same normalized variation for the gain factor, the average rate needs to be proportional to the square of the gain. Therefore the gain factor $G_{oms,i}(k)$ is computed by smoothing $G_{T,i}(k)$ with the following algorithm:

$$G_{oms,i}(k)=G_{oms,i}(k-1)+(\alpha_G G_{0,i}^2(k)(G_{T,i}(k)-G_{oms,i}(k-1))G_{0,i}(k)=G_{oms,i}(k-1)+0.25\times(G_{T,i}(k)-G_{oms,i}(k-1))$$

where $\alpha_G$ is a time constant between 0 and 1, and $G_{0,i}(k)$ is a pre-estimate of $G_{oms,i}(k)$ based on the latest gain estimate and the instantaneous gain. The output signal can be computed as $$\hat{S}_i(k)=G_{oms,i}(k)D_i(k).$$

It can be observed that $G_{oms,i}(k)$ is averaged over a long time when it is close to 0, but is averaged over a shorter time when it approximates 1. This creates a smooth noise floor while avoiding generating ambient speech.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of reducing noise by cascading a plurality of noise reduction algorithms, the method comprising:

receiving a noisy signal resulting from an unobservable signal corrupted by additive background noise;

applying a sequence of noise reduction algorithms to the noisy signal, wherein a first noise reduction algorithm in the sequence receives the noisy signal as its input and provides an output, and wherein each successive noise reduction algorithm in the sequence receives the output of the previous noise reduction algorithm in the sequence as its input and provides an output, with the final noise reduction algorithm in the sequence providing a system output signal that resembles the unobservable signal;

wherein the sequence of noise reduction algorithms includes a plurality of noise reduction algorithms that are sufficiently different from each other such that resulting distortions and artifacts are sufficiently different to result in reduced human perception of the artifact and distortion levels in the system output signal;

wherein applying the sequence of noise reduction algorithms further comprises:

receiving a stage input noisy signal;

determining an envelope of the stage input noisy signal, including considering attack and decay time constants for the noisy signal envelope;

determining an envelope of a noise floor in the stage input noisy signal, including considering attack and decay time constants for the noise floor envelope;

determining a gain based on the noisy signal envelope and the noise floor envelope; and applying the gain to the stage input noisy signal to produce a stage output, thereby providing one of the noise reduction algorithms in the sequence of noise reduction algorithms, wherein processing takes place independently in a plurality of subbands;

wherein applying the sequence of noise reduction algorithms further comprises:

receiving a second stage input noisy signal;

estimating background noise power with a recursive noise estimator having an adaptive time constant;

determining a preliminary filter gain based on the estimated background noise power and a total second stage input noisy signal power;

determining the noise cancellation filter gain by smoothing the variations in the preliminary filter gain to result in the noise cancellation filter gain having regulated normalized variation, thus a slower smoothing rate is applied during noise to avoid generating watery or musical artifacts and a faster smoothing rate is applied during speech to avoid causing ambient distortion; and applying the noise cancellation filter to the second stage input noisy signal to produce a second stage output, thereby providing another one of the noise reduction algorithms in the sequence of noise reduction algorithms, wherein processing takes place independently in a plurality of subbands;

wherein an average adaption rate for the noise cancellation filter gain is proportional to the square of the noise cancellation filter gain.

2. The method of claim 1 further comprising:

adjusting the adaptive time constant in the recursive noise estimator periodically based on a likelihood that there is no speech power present such that the noise power estimator tracks at a lesser rate when the likelihood is lower.

3. The method of claim 1 wherein the basis for normalizing the variation is a pre-estimate of the applied filter gain.

4. The method of claim 1 further comprising:

determining the gain according to:

$$G_i(k) = \frac{E_{SP,i}(k)}{\gamma_i E_{NZ,i}(k)}$$

wherein $E_{SP,i}(K)$ is the envelope of the noisy speech, $E_{NZ,i}(K)$ is the envelope of the noise floor, and $\gamma_i$ is a constant that is an estimate of the noise reduction.

5. The method of claim 1 further comprising:

determining the presence of voice activity; and suspending the updating of the noise floor envelope when voice activity is present.

* * * * *